US005421667A

United States Patent [19]

Leyden et al.

[11] Patent Number: 5,421,667

[45] Date of Patent: Jun. 6, 1995

[54] APPARATUS FOR CONNECTING A SECURITY CABLE TO A CONSUMER ARTICLE

[75] Inventors: Roger J. Leyden, Willow Springs; Terrance Surma, Bloomingdale, both of Ill.

[73] Assignee: Se-Kure Controls, Inc., Franklin Park, Ill.

[21] Appl. No.: 37,092

[22] Filed: Mar. 25, 1993

Related U.S. Application Data

[63] Continuation-in-part of Ser. No. 664,641, Feb. 21, 1991, Pat. No. Des. 335,439.

[51] Int. Cl.[6] ..... E05B 73/00

[52] U.S. Cl. ..... 403/406.1; 403/291; 403/294; 248/551; 70/58

[58] Field of Search ..... 248/551, 552, 553; 70/30, 49, 14, 57, 58, 229, 230, 232; 403/291, 406.1, 294

[56] References Cited

U.S. PATENT DOCUMENTS

| | | | |
|---|---|---|---|
| D. 335,439 | 5/1993 | Leyden . | |
| 1,687,966 | 10/1928 | Baver | 70/230 |
| 3,211,408 | 10/1965 | Schaefer | 248/553 |
| 3,643,810 | 2/1972 | Highberger | 70/58 |
| 3,664,163 | 5/1972 | Foote | 248/553 |
| 4,212,175 | 7/1980 | Zakow | 70/58 |
| 5,082,232 | 1/1992 | Wilson | 248/551 |
| 5,119,649 | 6/1992 | Spence | 70/58 |
| 5,197,706 | 3/1993 | Braithwaite | 70/58 |

*Primary Examiner*—Randolph A. Reese
*Assistant Examiner*—Anthony Knight
*Attorney, Agent, or Firm*—Wood, Phillips, Van Santen, Hoffman & Ertel

[57] ABSTRACT

An apparatus for connecting a security cable to a consumer article. The apparatus is a body having a cavity with an entry opening in communication with the cavity. Structure is provided for mounting the body to the wall of a consumer article in an operative position thereon wherein a wall on the consumer article to which the body is attached at least partially blocks the entry opening. With the inventive structure, a fitting on a security cable can be introduced into the body cavity with the body separated from a consumer article but is prohibited from being be removed from the body cavity with the body in its operative position on a consumer article.

20 Claims, 2 Drawing Sheets

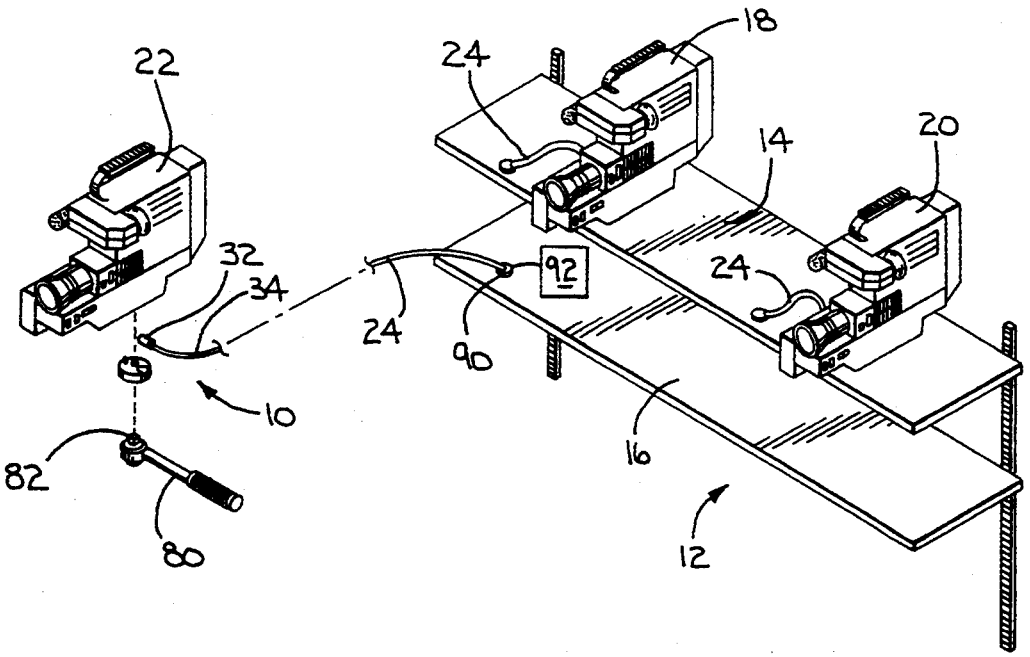
FIG. 1
FIG. 2
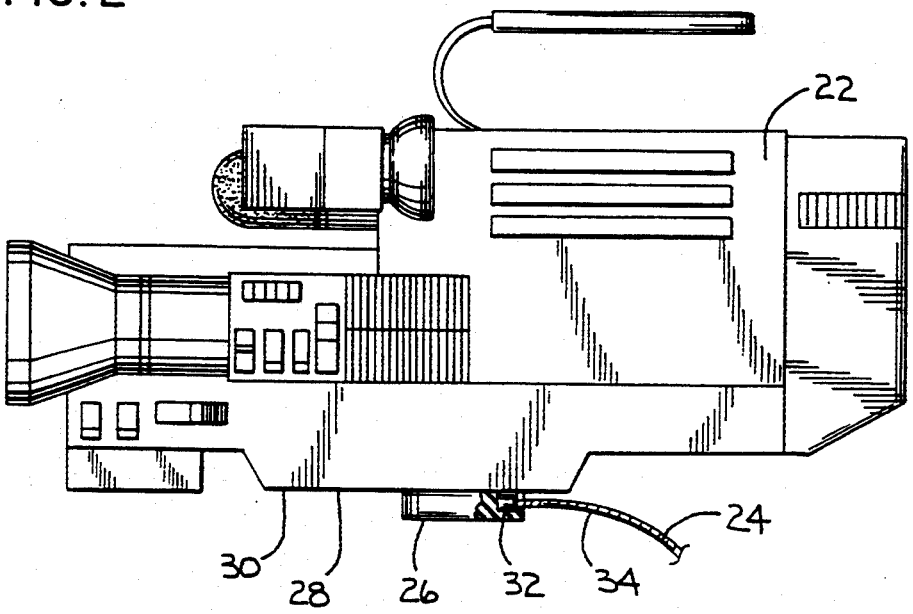

APPARATUS FOR CONNECTING A SECURITY CABLE TO A CONSUMER ARTICLE

CROSS REFERENCE

This application is a continuation-in-part of our application Ser. No. 664,641, filed Feb. 21, 1991, now U.S. Pat. No. Des. 335,439.

BACKGROUND OF THE INVENTION

1. Field of the Invention

This invention relates to security systems and, more particularly, to an apparatus for connecting a cable to consumer articles, such as camcorders, and the like, to prevent unauthorized removal of the articles from a predetermined area.

2. Background Art

Consumer articles, such as camcorders, and the like, are commonly displayed in retail establishments on open shelves so as to allow the consumer to compare brands. It is desirable to allow the consumer to pick the articles up to examine them and, in some cases, to actually operate the articles to assist in the purchase decision.

A tremendous amount of theft occurs in such establishments. With the large number of goods and consumers milling around in such establishments, it is easy for persons to walk off unnoticed with displayed articles.

One conventional way of preventing unauthorized removal of articles is to attach to the articles a flexible cable having a length sufficient to allow the consumer to pick up, examine and, in some instances, operate the particular article only within a certain range of the point of display, as dictated by the cable length. One problem with use of cables is that it is difficult to connect the cable to the article securely without causing damage thereto.

Adhesive bonding of the cable end to the article may cause permanent damage thereto. The use of a lasso connector on the cable has the advantage of not harming the article but may produce an obstruction that interferes with an operator's handling of the article.

SUMMARY OF THE INVENTION

The present invention is specifically directed to overcoming the above enumerated problems in a novel and simple manner.

More particularly, according to the invention, an apparatus is provided for connecting a security cable to a consumer article. The apparatus is a body having a cavity with an entryway in communication with the cavity. Structure is provided for mounting the body to the wall of a consumer article in an operative position thereon wherein a wall on the consumer article to which the body is attached at least partially blocks the entry opening. With the inventive structure, a fitting on a security cable can be introduced into the body cavity with the body separated from a consumer article but is prohibited from being removed from the body cavity with the body in its operative position on a consumer article.

With the inventive structure, the store owner can simply drop a fitting on a security cable into the cavity and effect connection of the body to the article to be secured to thereby prevent separation of the body from the consumer article and separation of the cable form the body.

The invention contemplates the above structure in combination with a security cable having an enlarged fitting thereon.

In one form, a screw is threaded into a consumer article to hold the body in place. The screw has an enlarged head defining a shoulder to abut the body to captively hold the body in conjunction with the consumer article. The body may be undercut to define a recessed wall to be engaged by the shoulder on the screw head to give the body a lower profile.

The mounting structure may include a locating pin projecting from the body and extendable into a bore in a consumer article to prevent undesired rotation of the body about the screw.

To avoid damage to the consumer article, a protective pad can be placed between the body and the article to prevent direct contact therebetween.

To prevent unauthorized removal of the body from the consumer article, the enlarged head on the screw may have a first fitting to be engaged by a tool to facilitate rotation thereof, with the first fitting being configured so that it cannot be engaged by a conventional tool, such as screwdriver or wrench, in such a manner as to allow rotation thereof.

Preferably, the body is made from metal so as to be highly durable and so that it cannot be easily cut from the article to which it attaches.

In one form, the screw projects from the body in a first line and the cavity is defined by a blind bore opening in the first line. The body has a peripheral wall with the entryway extending from externally of the body through the peripheral wall of the body and into communication with the cavity.

The invention further contemplates an apparatus for connecting a security cable including a security cable defining a first shoulder, a body defining a cavity for reception of a first portion of the security cable including the first shoulder with the body defining a second shoulder to abut the first shoulder with the first security cable portion in the cavity, structure for blocking the first security cable portion in the cavity, and structure for connecting the body to a consumer article.

The end of the cable remote from the body can be securely connected to the base by any suitable means.

The cable has a fitting thereon defining the first shoulder, which fitting may be cylindrical or spherical in shape. The latter allows a universal connection to be made between the cable end and the body.

The invention further contemplates the above structure in combination with a consumer article that is, for example, a camera. Typically, the camera has a threaded bore to accommodate a screw on a tripod. The body can be connected to the camera by a like screw.

A locating pin can be provided on the body to prevent rotation of the body relative to the camera. Typically, a suitable bore is provided in the camera to accommodate the locating pin.

The structure for blocking the first cable portion in the cavity can be a separate element or the consumer article itself.

BRIEF DESCRIPTION OF THE DRAWINGS

FIG. 1 is a perspective view of a conventional type point of purchase display for camcorders, with an exploded perspective view of an apparatus for connecting a security cable to one of the camcorders, according to the present invention;

FIG. 2 is a side elevation view of the inventive apparatus operatively connected to a camcorder;

DETAILED DESCRIPTION OF THE DRAWINGS

Figure 3:
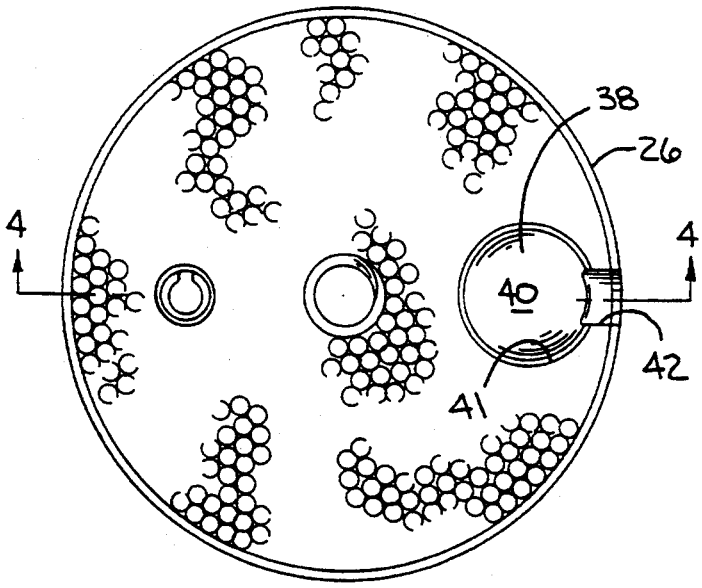
FIG. 3 is an enlarged plan view of a body on the inventive cable connecting apparatus.
Figure 4:
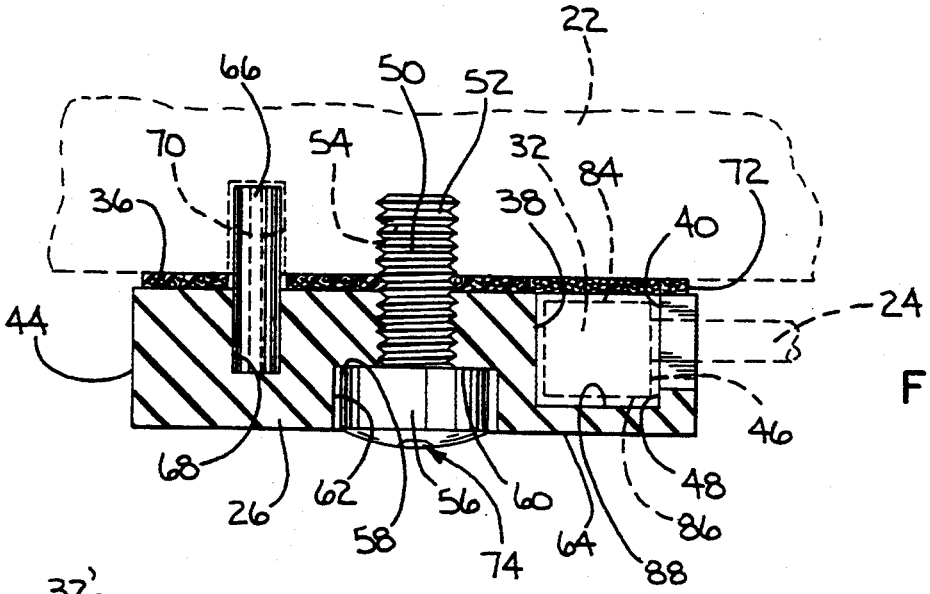
FIG. 4 is a cross-sectional view of the inventive cable connecting apparatus operatively connected to a consumer article.

In FIG. 1, a conventional point of purchase display is shown as an exemplary environment for the use of the inventive cable securing apparatus at 10. In FIG. 1, a display is shown at 12, to include spaced shelves 14, 16, atop which a series of camcorders 18, 20, 22 are placed for display. The objective of the present invention is to connect cables 24 to the camcorders 18, 20, 22 in such a fashion that the consumer is allowed to pick the camcorders 18, 20, 22 up from the shelves 14, 16, as to perform an inspection, and manipulate the camcorders 18, 20, 22 as they would be used in normal operation. At the same time, the cables 24 limit the distance that the camcorders 18, 20, 22 can be moved away from the display 12 so that unauthorized removal of the camcorders 18, 20, 22 is prevented.

The details of the inventive apparatus 10 can be seen in the remainder of FIGS. 2–5, taken in conjunction with FIG. 1. The apparatus 10 consists of a solid body 26 which can be attached to a surface 28 on the bottom wall 30 of the camcorder 22. It should be understood that while the inventive apparatus 10 is particularly suitable for connection to a camcorder, it can be used in similar fashion to secure virtually an infinite number of different consumer articles.

The body 26 cooperates with a fitting 32 on the end 34 of the cable 24. More particularly, the body 26 is configured to accept the cable fitting 32 and lock the cable fitting 32 relative to the camcorder 22.

The body 26 has a flat surface 36 to abut to the camcorder surface 28 with the body 26 operatively connected to the camcorder 22. The body 26 is preferably made from metal so as to discourage tampering therewith. The shape of the body 26 is a design consideration and virtually an infinite number of different shapes are contemplated by the present invention. A blind bore 38 is formed in the body 26 to define a cavity 40 to accept the cable fitting 32. The bore has an entryway 41 through the surface 36. With the cable fitting 32 in the cavity 40, the fitting 32 does not project upwardly beyond the body surface 36.

To accommodate the cable 24 projecting away from the fitting 32, an entryway 42 is formed through the peripheral wall 44 of the body and extends from externally of the body 26 into communication with the cavity 40.

To effect assembly of the apparatus 10, the fitting 32 is dropped into the cavity 40 before the body 26 is attached to the camcorder 22. Once the body 26 is connected to the camcorder 22, the surface 28 on the camcorder wall 30 blocks the fitting 32 so as to prevent it from being drawn out of the cavity 40 in a direction oppositely to the assembly direction. The entryway 42 has a diameter that is smaller than the effective diameter of the fitting 32. Resulting, any attempt to draw the fitting 32 through the entryway 42 causes a shoulder 46 on the fitting 32 to abut to a shoulder 48 on the body surrounding the opening 42.

The volume of the bore 38 is significantly less than the volume of the body 26 so that the body strength is not significantly compromised by the bore 38.

To effect positive connection of the body 26 to the camcorder 22, a screw 50 is used. The screw 50 has a threaded body 52 which is preferably of a size to thread into the bore 54 in the camcorder 22 that is conventionally provided to accommodate a standard tripod screw. The screw 50 has an enlarged head 56 defining an annular shoulder 58 to abut to an undercut shoulder 60 defined by a bore 62 in the body 26. The shoulder 58 captively maintains the body 26 against the camcorder 22. The recessed bore 62 limits the projection of the head 56 downwardly from the bottom surface 64 of the body 26 for a cleaner look.

It can be seen that through a very simple operation, the cable 24 can be positively connected to the camcorder 22. That is, the assembler need only drop the fitting 32 in the cavity 40 and thereafter tighten the screw 50 to the camcorder 22. No modification of the camcorder 22 is required to effect positive connection of the body 26, and thus the cable 24, thereto.

To prevent undesired rotation of the body 26 about the screw 50, a locating pin 66 is provided in offset and parallel relationship to the screw 50. The pin 66 is embedded in a bore 68 in the body 26 and projects upwardly into a standard bore 70 in the bottom wall 30 of the camcorder 22. The locating pin 66 does not alter the assembly process for the body 26.

To prevent potentially damaging contact between the metal body 26 and the camcorder 22, a soft pad 72 is interposed between the body surface 26 and the surface 28 of the camcorder wall 30. The pad 72 can be adhered to the body 26 in a preassembly step.

To prevent unauthorized removal of the body 26 from an article, the screw 50 is provided with a tamperproof fitting 74 that may be a recess and/or projection. The fitting 74 is non-standard so that it will not accommodate a conventional wrench or screwdriver that would permit unauthorized removal of the screw 50. The fitting shown has a hexagonal recess 76 with a projection/centerpost 78 therein. A special tool 80 has a complementary fitting 82 to make keyed connection with the fitting 74 to allow the screw 50 to be rotated with the tool 80 to effect assembly/disassembly of the body 26.

The fitting 32 can be configured to be substantially matched to the configuration of the cavity 40. In FIGS. 1–5, the fitting 32 is shown to have a generally cylindrical configuration with a diameter slightly less than that of the cylindrical bore 38. The fitting 32 has upper and lower walls 84, 86 to abut the camcorder wall 30 and bounding cavity wall 88, respectively, to limit opposite vertical movement within the cavity 40 and prevent rotation of the fitting 32 about the length of the cable 24.

Figure 6:
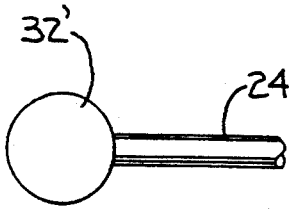
FIG. 6 is a side elevation view of a portion of a security cable with a modified form of end fitting to be received by the body.
Figure 5:
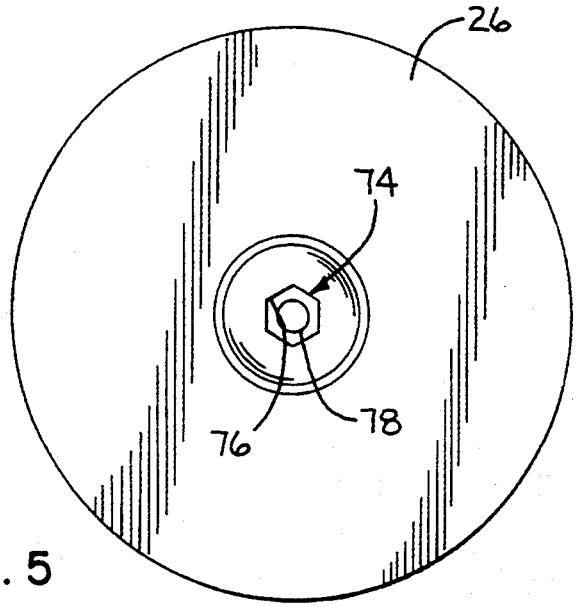
FIG. 5 is an enlarged bottom view of the body in FIG. 3.

It may be desirable to allow swiveling of the body 26 about the cable 24. This can be accomplished by using a modified form of end fitting 32', as shown in FIG. 6. The end fitting 32' has a spherical shape and performs the same function of preventing withdrawal of the fitting 32' from the cavity 40 while allowing the body to rotate universally relative to the end fitting 32' about the length of the cable 24.

With the apparatus 10 connected to the camcorder 22, the cable end 90 remote from the cable end 34 can be fixedly attached to one of the shelves 14, 16, as by an anchor 92, shown schematically in FIG. 1. It can be seen that the inventive apparatus can be easily assembled. At the same time, a positive connection between the cable 24 and camcorder 22 results without any alteration to, or damaging of the camcorder 22.

The foregoing disclosure of specific embodiments is intended to be illustrative of the broad concepts comprehended by the invention.

We claim:

1. An apparatus for connecting a security cable to a consumer article, said apparatus comprising:

a body having a substantially flat surface with an area and a cavity with an entryway extending through the flat surface in communication with the cavity; and means for mounting the body to a wall on a consumer article in an operative position thereon so that the flat body surface is facially presented to a wall on a consumer article and wherein a wall on a consumer article to which the body is attached at least partially blocks the entryway, whereby a fitting on a security cable that can be introduced into the body cavity with the body separated from a consumer article cannot be removed from the body cavity with the body in its operative position on a consumer article, said entryway having an area through the flat surface that is substantially less than the area of the flat body surface.

2. The cable connecting apparatus according to claim 1 in combination with a security cable having an enlarged fitting thereon.

3. The cable connecting apparatus according to claim 1 wherein the body mounting means includes a screw means to be threaded into a consumer article and having an enlarged head defining a shoulder to abut to the body and captively hold the body against a consumer article.

4. The cable connecting apparatus according to claim 3 wherein the body mounting means includes a locating pin projecting from the body and extendable into a bore in a consumer article, said locating pin being offset from the screw means.

5. The cable connecting apparatus according to claim 3 including a thin pad that can be placed between the flat body surface and a consumer article to prevent direct contact between the flat body surface and a consumer article.

6. The cable connecting apparatus according to claim 3 wherein the body is undercut to define a recessed wall to be engaged by the shoulder on the enlarged head of the screw means.

7. The cable connecting apparatus according to claim 3 wherein the enlarged head on the screw means has a first fitting to be engaged by a tool to facilitate rotation of the screw means by a tool with a complementary second fitting, said first fitting being configured so that it cannot be engaged by a conventional screwdriver or wrench to effect rotation of the screw means.

8. The cable connecting apparatus according to claim 1 wherein the body mounting means includes a screw projecting from the body in a first line, and the cavity is defined by a blind bore opening in said first line, said blind bore being cylindrical with a central axis that is parallel to the first line.

9. The cable connecting apparatus according to claim 8 wherein the body has a peripheral wall and the entryway extends from externally of the body through the peripheral wall of the body and into communication with the cavity.

10. The cable connecting apparatus according to claim 1 wherein the body is made from metal and has a central axis parallel to the first line and the central axis of the blind bore is spaced from the central axis of the body.

11. The cable connecting apparatus according to claim 1 including means for connecting a second portion of the security cable remote from the first cable portion fixedly to a base.

12. The cable connecting apparatus according to claim 1 in combination with a consumer article that is a portable camera, having a preformed bore to accept the body connecting means.

13. The cable connecting apparatus according to claim 12 wherein the camera has a threaded bore to accommodate a screw on a tripod and the body connecting means includes screw means to be threaded into the bore on the camera.

14. The cable connecting apparatus according to claim 13 including means separate from the screw means for preventing rotation of the body relative to the camera with the body connected to the camera.

15. The cable connecting apparatus according to claim 1 wherein the cable has a fitting thereon defining the first shoulder.

16. The cable connecting apparatus according to claim 15 wherein the fitting has a cylindrical shape.

17. The cable connecting apparatus according to claim 15 wherein the fitting has a spherical shape.

18. The cable connecting apparatus according to claim 1 wherein the body has a blind bore defining the cavity, a peripheral wall and an entryway to accommodate a cable extending from externally of the body to the cavity.

19. An apparatus for connecting a security cable to a consumer article, said apparatus comprising:

a security cable defining a first shoulder;

a body defining a cavity for reception of a first portion of the security cable including the first shoulder, said body defining a second shoulder to abut the first shoulder with the first security cable portion in the cavity; and means for connecting the body to a consumer article, whereby with the body attached to a consumer article the first cable portion cannot be separated from the body so that a consumer article to which the body is attached cannot be transported beyond a distance permitted by the length of the security cable, wherein the body has a cylindrical shape with a central axis, the cavity has a cylindrical shape with an axis parallel to and spaced from the central axis of the body so that the cavity does not intersect the central body axis and the means for connecting the body to a consumer article includes a screw for extending through the body and into a consumer article to bear the body against a consumer article and a locating pin which projects from the body to penetrate a consumer article to prevent undesired rotation of the body relative to a consumer article to which it attaches.

20. An apparatus for connecting a security cable to a consumer article, said apparatus comprising:

a body having a surface with an area and a cavity with an entryway extending through the body surface in communication with the cavity; and means for mounting the body to a wall on a consumer article in an operative position thereon so that the body surface is facially presented to a wall on a consumer article and wherein a wall on a consumer article to which the body is attached at least partially blocks the entryway, whereby a fitting on a security cable that can be introduced into the body cavity with the body separated from a consumer article cannot be removed from the body cavity with the body in its operative position on a consumer article, said entryway having an area through the body surface that is substantially less than the area of the body surface.

* * * * *